US005718597A

United States Patent [19]

Kodama

[11] Patent Number: 5,718,597

[45] Date of Patent: Feb. 17, 1998

[54] ELECTRICAL CONNECTOR WITH ENGAGEMENT GUIDE MECHANISM

[75] Inventor: Shinji Kodama, Haibara-gun, Japan

[73] Assignee: Yazaki Corporation, Tokyo, Japan

[21] Appl. No.: 696,516

[22] Filed: Aug. 14, 1996

[30] Foreign Application Priority Data

Sep. 6, 1995 [JP] Japan ..... 7-229289

[51] Int. Cl.[6] ..... H01R 13/631

[52] U.S. Cl. ..... 439/374

[58] Field of Search ..... 439/374, 376

[56] References Cited

U.S. PATENT DOCUMENTS

| | | | |
|---|---|---|---|
| 3,755,771 | 8/1973 | Brush | 439/248 |
| 4,921,434 | 5/1990 | Kataoka et al. | 439/374 |
| 5,507,653 | 4/1996 | Stoner | 439/374 |

FOREIGN PATENT DOCUMENTS 5-11361 2/1993 Japan .

*Primary Examiner*—Gary F. Paumen

*Attorney, Agent, or Firm*—Armstrong, Westerman, Hattori, McLeland & Naughton

[57] ABSTRACT

A pair of connector housings engage each other, one of which having a hood portion receiving the other connector housing. The hood portion is composed of upper, lower, right and left walls, each of which is formed with a couple of mutually opposing inclined surfaces opening divergently in the housing engagement direction. The other connector housing has guiding protrusions, each of which extending outwardly from its peripheral walls and received by the couple of mutually opposing inclined surfaces when the connector housings engages each other. Preferably, the one of connector housings is formed with a stopping hole positioned at a convergent end of the couple of inclined surfaces and receiving the guiding protrusion.

4 Claims, 4 Drawing Sheets

ELECTRICAL CONNECTOR WITH ENGAGEMENT GUIDE MECHANISM

BACKGROUND OF THE INVENTION

1. Field of the Invention

This invention relates to a connector utilized for connection in electrical wiring and, more particularly, to a connector having a pair of mating connector housings with an engagement guiding mechanism for easily smoothly aligning the housings toward their complete engagement.

2. Description of the Prior Art

Japanese Utility Model Application laid-open No. H. 5-11361 discloses an electrical connector as shown in FIG. 5, which enables easy alignment of a pair of its connector housings in their engagement operation.

The electrical connector K includes the pair of connector housings a, b. The connector housing a has a protruding guide bar d with a diameter gradually reducing, fore end portion c. The other connecting housing b has a square hole f with a flared opening e.

In normal engagement of the connector housings a, b, the guide bar d of the connector housing a is inserted into the square hole f of the connector housing b so that the connector housings a, b align for their correct engagement. Since the square hole f has the flared opening e, easy insertion of the guide bar d into the flared opening e enables correct engagement of the pair of connector housings a, b.

However, because of such wrong initial alignment of the housings as FIG. 6 illustrates, the diameter gradually reducing, fore end portion c of the guide bar d may abut against and damage a terminal fitting g received in the connector housing b. Therefore, necessary careful initial alignment of the pair of connector housings a, b requires longer engagement work, which is a drawback in engagement work of the pair of connectors.

SUMMARY OF THE INVENTION

In view of the drawback, an object of this invention is to provide a connector with an engagement guiding mechanism for correctly aligning a pair of mating housings of the connector. Wherein, without damaging terminal fittings received in the connector housings, easy, prompt engagement of the housings is enabled.

For achieving the object, an electrical connector with an engagement guide mechanism according to the present invention includes:

a pair of connector housings engaging each other, a hood portion provided in one of the connector housings and receiving the other connector housing, wherein the hood portion is composed of upper, lower, right and left walls, each of which is formed with a couple of mutually opposing surfaces inclined to define an opening extending divergently forward; the other connector housing has upper, lower, right and left peripheral walls, each of which is provided with a guiding protrusion standing thereon.

Preferably, each of the upper, lower, right and left walls of the one of connector housings is formed with a stopping hole positioned at a convergent end of the couple of inclined surfaces and receiving the guiding protrusion.

Preferably, the other connector housing has diagonally tapered surfaces each formed at each fore end corner of the other connector housing.

In use, since the connector with the engagement guiding mechanism has the pair of connector housings, the one of connector housings having the hood portion composed of upper, lower, right and left walls, each of which is formed with a couple of mutually opposing inclined surfaces opening divergently in the housing engagement direction; the other connector housing having guiding protrusions standing from the wall of the other connector in relation to the couples of mutually opposing inclined surfaces, only moving the pair of connector housings toward each other can guide them to their correct alignment. Thereby, the connectors can easily correctly engage each other without visual careful confirmation of preliminary appropriate relative positions of the connectors. Besides, there are not axially directed engagement guide protrusions that cause damage of terminal fittings in a connector housing. Accordingly, easy, prompt engagement operation of the housings is enabled, which has the advantage of improving productivity in a connector engagement process.

DETAILED DESCRIPTION OF PREFERRED EMBODIMENTS

Figure 1:
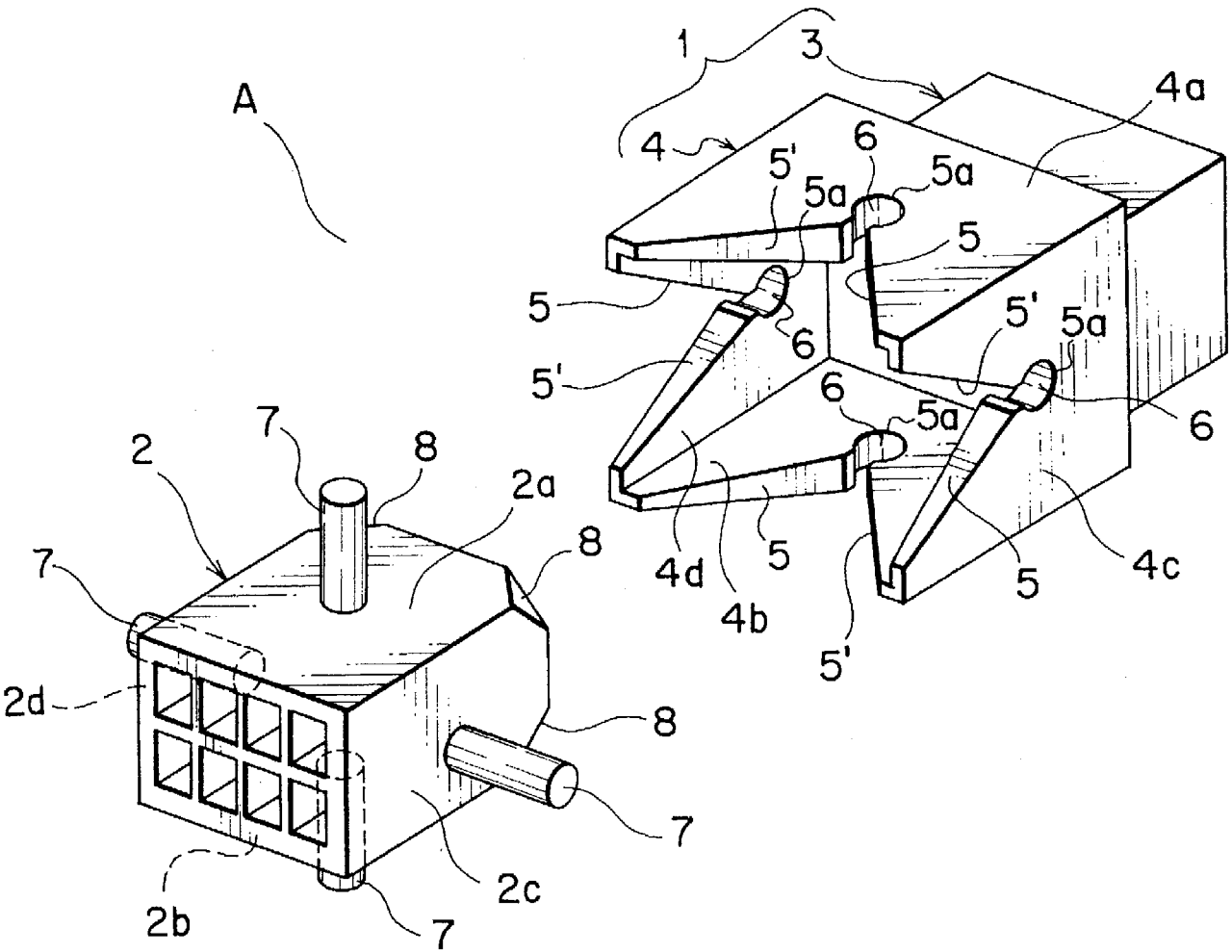
FIG. 1 is a perspective view showing a connector with an engagement guide mechanism, in which a pair of connector housings are separated, according to the present invention.

FIG. 1 is a perspective view showing a connector A with an engagement guiding mechanism according to the present invention.

The connector A with an engagement guiding mechanism has a pair of mutually mating connector housings 1, 2.

One of the connector housings 1 formed from an electrical insulation synthetic resin material by a molding process has a main body 3 and a hood portion 4. The hood portion 4 extends forward from the main body 3 accommodating a plurality of male terminal fittings (not shown) and receives the opposing connector housing 2.

The hood portion 4 shaped like a rectangular frame has upper, lower, left, and right walls 4*a*, 4*b*, 4*c*, 4*d*, each of which is formed with a couple of inclined surfaces 5, 5' opposing to the connector housing 2. The couple of inclined surfaces 5, 5' define a V-shaped opening and a stopping hole 6 is formed in a convergent portion 5*a* of the couple of inclined surfaces 5, 5'.

The opposing connector 2 formed, in the same way as the connector housing 1, from the electrical insulation synthetic resin material by a molding process accommodates a plurality of female terminal fittings (not shown) therein. The connector housing 2 has upper, lower, left, and right peripheral walls 2*a*, 2*b*, 2*c*, 2*d*, each of which is formed with a guiding protrusion 7 in circular cylinder shape extending vertically from each of the walls 2*a*, 2*b*, 2*c*, and 2*d*.

The opposing connector housing 2 has diagonally tapered surfaces 8 each formed in each of four fore corners of the opposing connector housing 2, which is positioned at each fore end portion of the walls 2*a*, 2*b*, 2*c*, and 2*d*.

Figure 2:
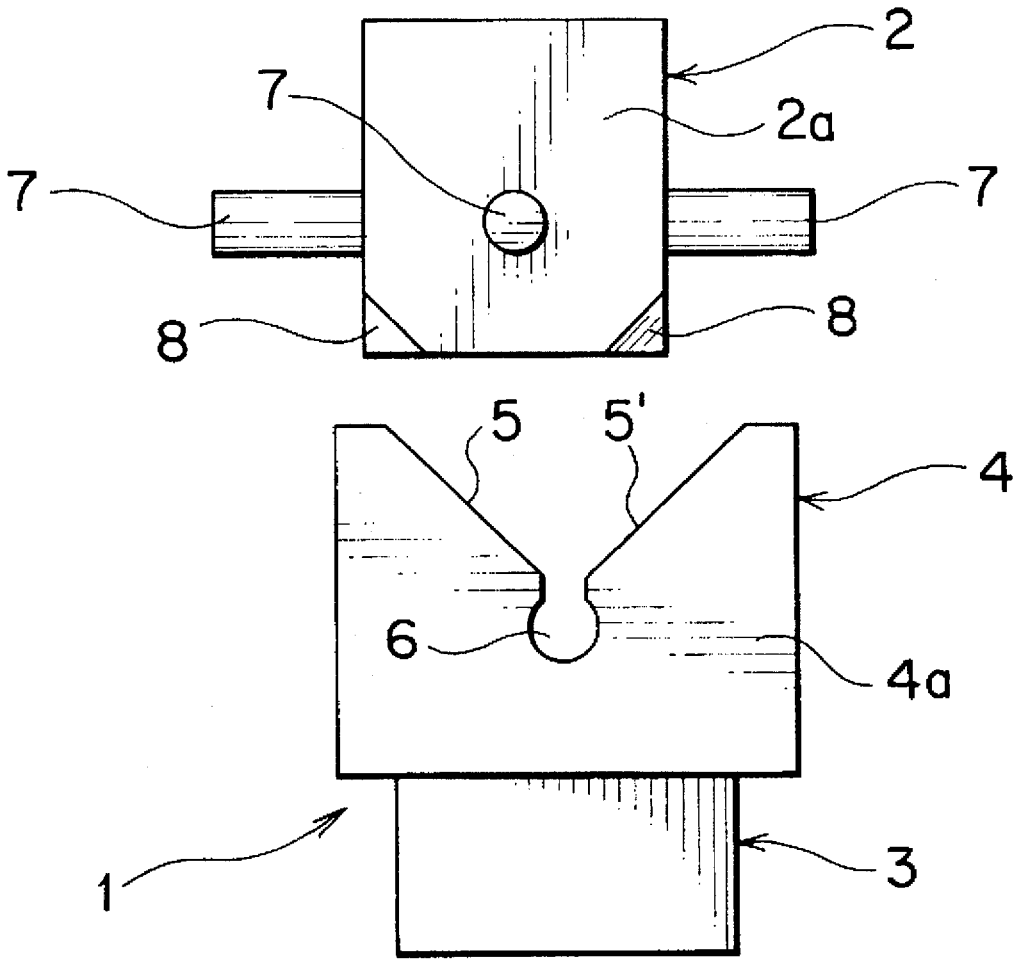
FIG. 2 is an explanatory illustration showing an engagement stage of the pair of connector housings in FIG. 1.

Next, referring to FIG. 2, an engagement process in the pair of connector housings 1, 2 will be discussed. At first, each of the walls 4*a*, 4*b*, 4*c*, and 4*d* of the hood portion 4 of the one of connector housings 1 is positioned oppositely and comes close to each of the outer peripheral walls 2*a*, 2*b*, 2*c*, and 2*d* of the opposing connector housing 2.

Figure 3:
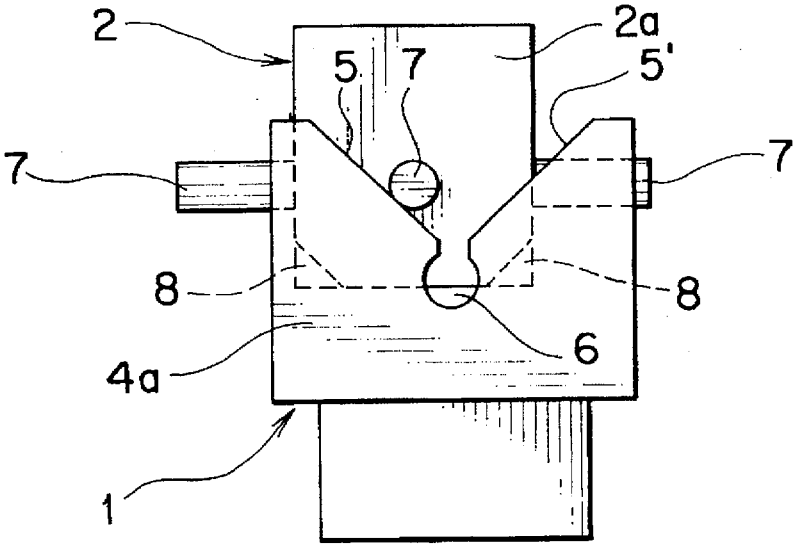
FIG. 3 is an explanatory illustration showing an engagement stage of the pair of connector housings in FIG. 1, the housings being not in line with each other.

Then, even if the pair of housing connectors 1, 2 do not align with each other as shown in FIG. 3, the guiding protrusions 7 of the opposing connector 2 slidably abuts against one of the couple of inclined surfaces 5, 5' (the inclined surface 5 in the case of FIG. 3). Inserting the opposing connector 2 into the hood portion 4 of the one of connector housings 1 guides the guiding protrusions 7 along the inclined surfaces 5 or 5' to engage the guiding protrusions 7 with the stopping holes 6.

Further, the tapered surface 8 formed in each of the four fore corners of the opposing connector housing 2 enhances correct positioning of the guiding protrusion 7 on each of the inclined surfaces 5, 5'.

Figure 4:
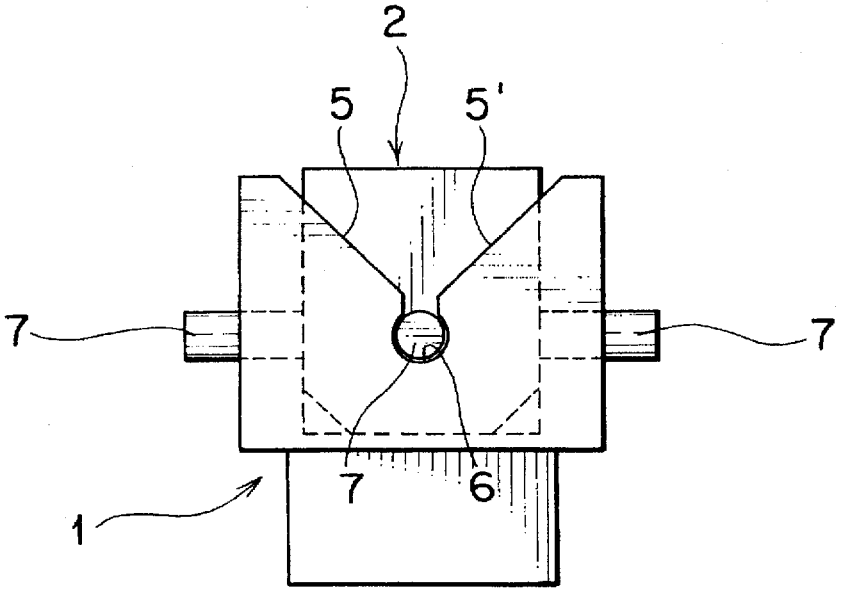
FIG. 4 is an explanatory illustration showing a complete engagement stage of the pair of connector housings in FIG. 1.
Figure 5:
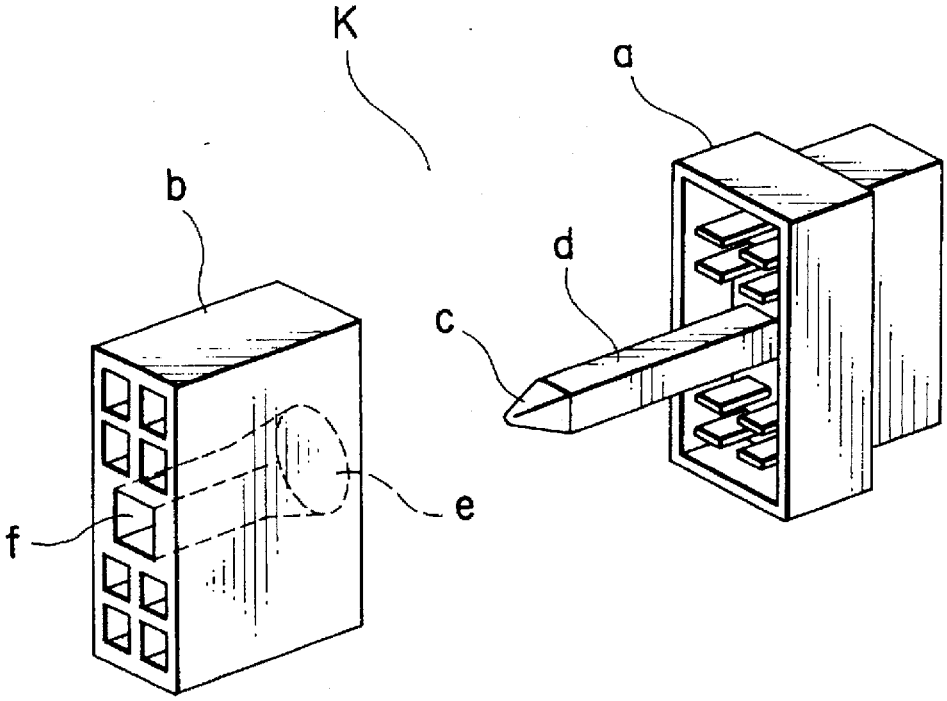
FIG. 5 PRIOR ART
FIG. 5 is a perspective view showing a conventional connector with an engagement guiding mechanism.
Figure 6:
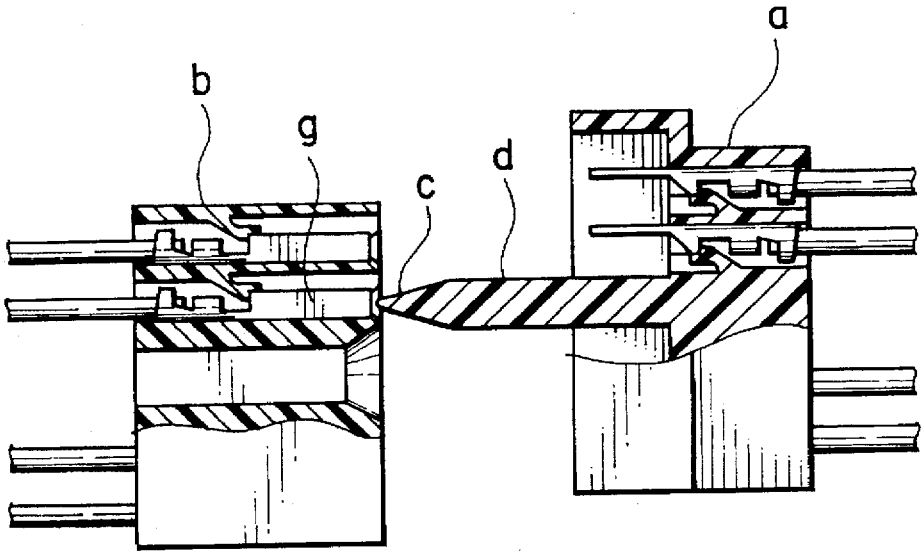
FIG. 6 PRIOR ART
FIG. 6 is an explanatory illustration showing a pair of mating connector housings of the connector of FIG. 5 with a guiding bar in a preliminary engagement stage.

In FIG. 3, there are shown the wall 4*a* of the hood portion 4 and the peripheral wall 2*a* of the opposing connector housing 2, which are in an initial engagement stage. Similarly, in the case of each of the other walls 4*b*, 4*c*, 4*d* and each of the other peripheral walls 2*b*, 2*c*, 2*d*, the guiding protrusion 7 is guided along the inclined surface 5 to automatically correct relative positions of the pair of connector housings 1, 2. This achieves complete engagement of the pair of connectors 1, 2 as shown FIG. 4.

What is claimed is:

1. An electrical connector with an engagement guide mechanism comprising:

a pair of connector housings engaging each other in an engagement direction, a hood portion provided on one of said connector housings and receiving the other connector housing, wherein said hood portion is composed of upper, lower, right and left walls, each of which is formed with a pair of mutually opposed inclined surfaces opening divergently in the engagement direction, and the other connector housing has upper, lower, right and left peripheral walls, each of which is provided with a guiding protrusion standing thereon which is to be received between the respective pair of inclined surfaces.

2. An electrical connector with an engagement guide mechanism as claimed in claim 1, wherein each of said upper, lower, right and left walls of said one of connector housings is formed with a stopping hole positioned at a convergent end of said pair of inclined surfaces and receiving said guiding protrusion.

3. An electrical connector with an engagement guide mechanism as claimed in claim 1, wherein the other connector housing has diagonally tapered surfaces formed at each fore end corner thereof.

4. An electrical connector with an engagement guide mechanism as claimed in claim 2, wherein the other connector housing has diagonally tapered surfaces formed at each fore end corner thereof.

* * * * *